US005149228A

United States Patent [19]

Pienaar et al.

[11] Patent Number: 5,149,228

[45] Date of Patent: Sep. 22, 1992

[54] PROP PRELOADING APPARATUS

[75] Inventors: Frans R. P. Pienaar, Noordheuwel; Brian P. Lewis, Meredale; Graham Clark, Boksburg, all of South Africa

[73] Assignee: HL&H Timber Products (Proprietary) Limited, Johannesburg, South Africa

[21] Appl. No.: 721,268

[22] Filed: Jun. 26, 1991

[51] Int. Cl.[5] ..... E21D 15/32

[52] U.S. Cl. ..... 405/289; 248/357

[58] Field of Search ..... 248/357, 351, 354.1, 248/354.6, 200.1; 405/290, 289, 280

[56] References Cited

U.S. PATENT DOCUMENTS

| | | | |
|---|---|---|---|
| 3,703,269 | 11/1972 | Meriz | 248/354.1 |
| 4,004,771 | 1/1977 | Plevak et al. | 248/357 |
| 4,120,164 | 10/1978 | Tomlin | 405/289 |
| 4,255,071 | 3/1981 | Koppers et al. | 405/290 |
| 4,773,792 | 9/1988 | Landers | 405/289 X |
| 5,054,964 | 10/1991 | Salzmann et al. | 405/289 |

FOREIGN PATENT DOCUMENTS

| | | | |
|---|---|---|---|
| 1027157 | 4/1958 | Fed. Rep. of Germany | 248/357 |
| 1027158 | 4/1958 | Fed. Rep. of Germany | 248/357 |
| 1085120 | 7/1960 | Fed. Rep. of Germany | 405/289 |
| 1177588 | 9/1964 | Fed. Rep. of Germany | 248/357 |
| 0912947 | 3/1982 | U.S.S.R. | 405/289 |
| 0396454 | 8/1933 | United Kingdom | 248/357 |

*Primary Examiner*—Ramon O. Ramirez

[57] ABSTRACT

The prop preloading apparatus comprises a frame and means for supporting the frame on an end of an elongate prop in a manner permitting at least limited swivelling movement of the frame relative to the prop about at least one axis transverse to the axis of the prop. The apparatus also includes a flexible preload bag which is inflatable with a settable substance and which is dimensioned to be supported by the frame.

11 Claims, 4 Drawing Sheets

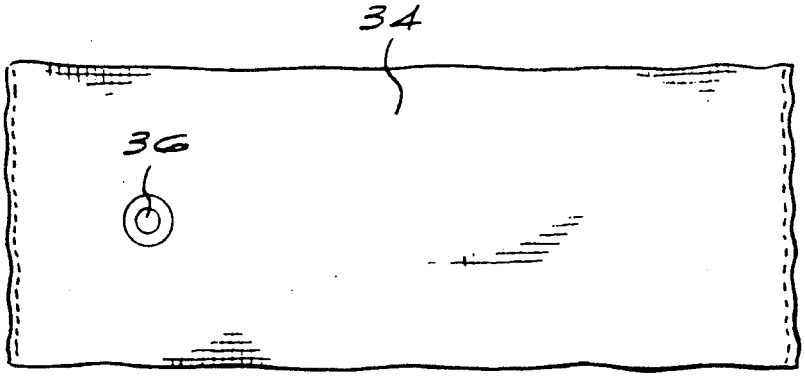
FIG 7
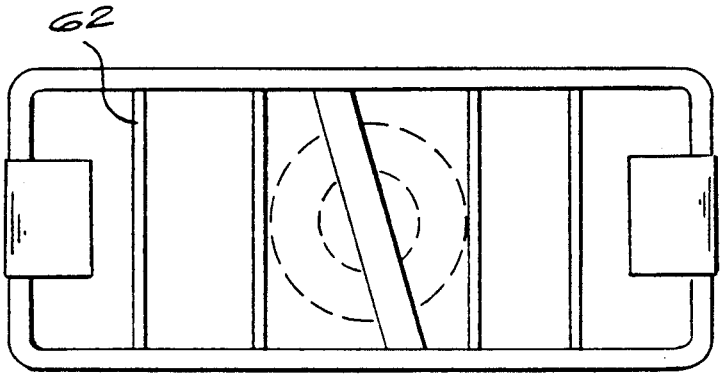
FIG 8
FIG 9
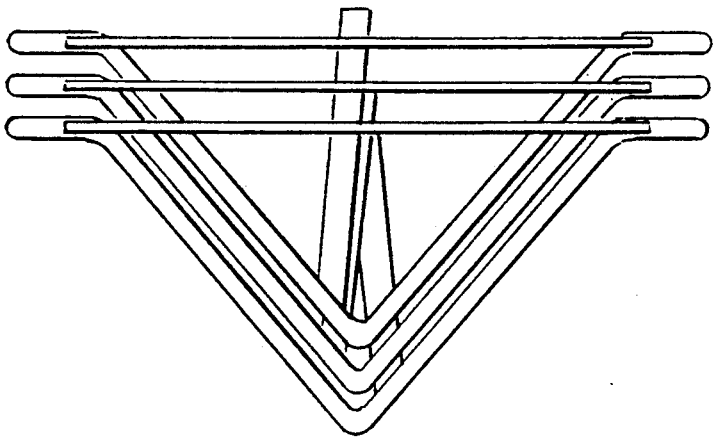

PROP PRELOADING APPARATUS

BACKGROUND OF THE INVENTION

This invention relates to a preloading apparatus for an elongate prop such as is used in underground mines to provide a yielding support for a hanging wall relative to a footwall.

A large proportion of the elongate props used underground in mines comprise or consist of a timber pole. In use, the pole is cut to length and the prop is arranged upright between the hanging and foot walls. The prop is then wedged into position between the hanging and foot walls by means of separate timber wedges which are hammered into position between the upper end of the prop and the hanging wall. This wedging of the prop gives it stability to prevent it from falling over when nearby blasting takes place or the prop is impacted by underground personnel or equipment.

In addition to merely wedging the prop in position, however, it would be desirable to apply to it some compressive force such that the prop is immediately ready to take the full compressive load which is imposed thereon when the hanging wall closes on the footwall with passage of time.

SUMMARY OF THE INVENTION

A first aspect of the invention provides a prop preloading apparatus comprising a frame, means for supporting the frame on an end of an elongate prop in a manner permitting at least limited swivelling movement of the frame relative to the prop about at least one axis transverse to the axis of the prop, and a flexible preload bag which is inflatable with a settable substance and which is dimensioned to be supported by the frame.

The frame in one version of the invention includes a support member in the form of a tray for receiving and supporting the bag. There may also be a cover member which makes a telescopic fit with the tray and which, in combination with the support member, forms and enclosure for the bag. In this version, the means for supporting the frame on the end of the prop includes an open-ended pot for receiving the head of the prop and means connecting the tray to the pot in a manner permitting the tray bears upon the pot and is able to pivot relative to the pot about an axis transverse to the prop axis. The tray may have an arcuate bearing surface which bears upon a complemental arcuate surface on the pot.

In another version, the means for supporting the frame on the end of the prop comprises a stirrup in the form of a strap which is connected to the frame and which passes in use over the end of the prop. Conveniently, but not necessarily, the strap is flexible. Typically, the frame is an open frame presenting spaced apart, V-shaped limbs which locate in use on opposite sides of the end of the prop. The frame preferably includes a pair of spaced members which span between the arms of the respective V-shaped limbs, which receive the end of the prop between them in use, and which define the limit of swivelling movement of the frame relative to the prop. In a particularly preferred embodiment, restraining means are fixed to the frame to restrain transverse movement of the bag relative to the prop. Conveniently, the restraining means comprise sheets of steel fixed to opposite ends of the frame, the sheets being bent inwardly towards one another to define spaces between themselves and the frame into which the ends of the bag can be inserted.

For ease of transportation, it is preferred that the ends of the strap are fixed to the limbs at positions adjacent to but off-set from the apices of the V-shapes, the arrangement being such that the frame can stack compactly with another similar frame with the limbs nesting snugly within the limbs of the other frame. For lightness, it is preferred that the limbs are of tubular steel and are connected to one another by tubular steel joining portions at opposite ends of the frame.

The bag has the same structure as a PACK SETTER bag.

A second aspect of the invention provides a prop preloading unit comprising a frame, means for supporting the frame on an end of an elongate prop in a manner permitting at least limited swivelling movement of the frame relative to the prop about at least one axis transverse to the axis of the prop, and the frame being adapted to support a flexible preload bag which is inflatable with a settable substance.

A third aspect of the invention provides a prop preloading unit comprising a frame of open construction and made up of elongate frame members, the frame carrying means for supporting it on the end of an elongate prop in a manner permitting at least limited swivelling movement of the frame on the end of the prop, and the frame being adapted to support a flexible preload bag inflatable with a settable substance.

In this unit, the means for supporting the frame on the end of the prop may comprise a clamp engagable with the periphery of the prop, or spikes engagable with the prop.

A fourth aspect of the invention provides a preferred preloading unit comprising a frame of open construction and made up of elongate frame members, the frame carrying a strap for passing over the end of an elongate prop for supporting the frame on the end of the prop, and the frame being adapted to support a flexible preload bag inflatable with a settable substance. Preferred features of this unit are summarised above.

BRIEF DESCRIPTION OF THE DRAWINGS

The invention will now be described in more detail, by way of example only, with reference to the accompanying drawings in which:

FIG. 7 shows a plan view of the inflatable bag used for preloading;

FIG. 8 shows a plan view of the frame seen in FIGS. 3 to 6; and

FIG. 9 shows how frames of the kind seen in FIG. 3 can be stacked compactly together.

DESCRIPTION OF EMBODIMENTS

Figure 1:
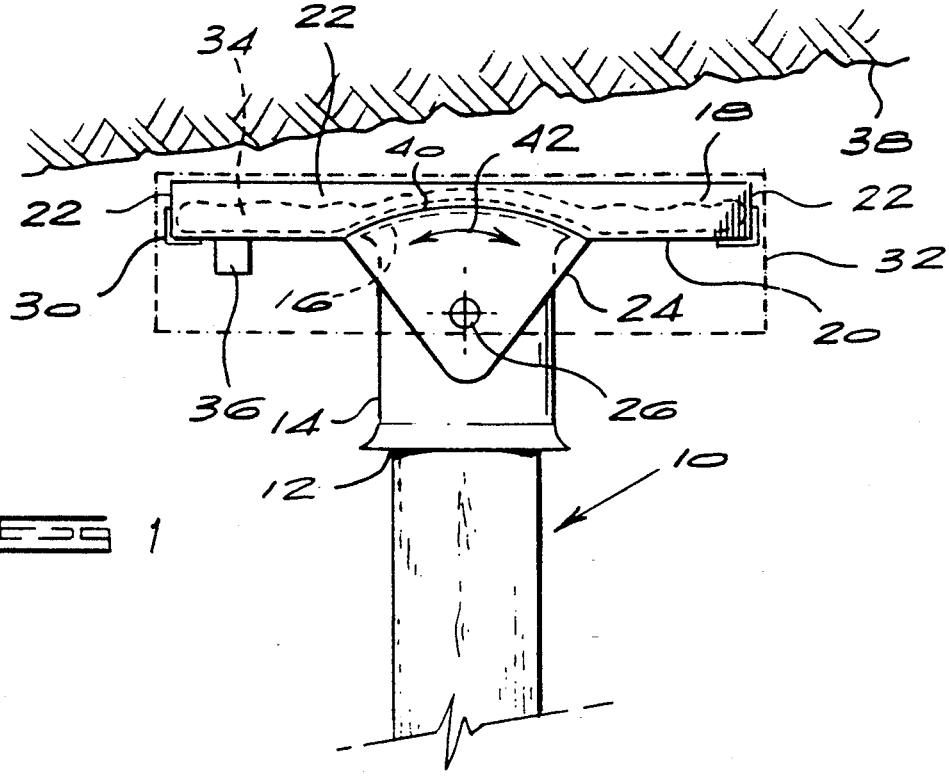
FIG. 1 shows a side view of the upper end of an elongate prop fitted with a first embodiment of a device of the invention prior to inflation of the bag.
Figure 2:
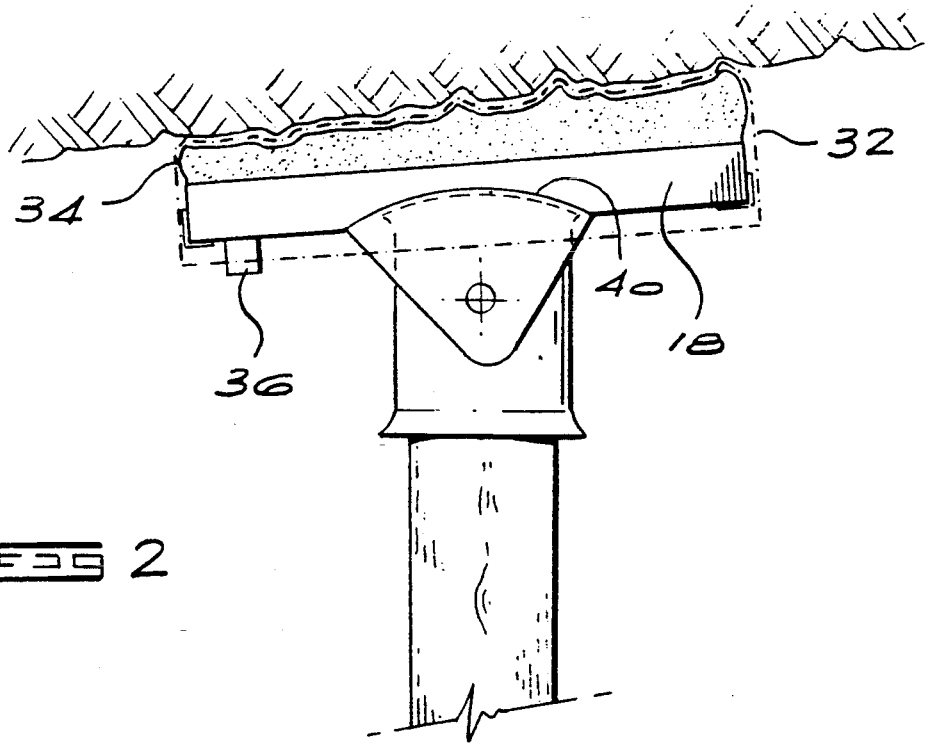
FIG. 2 shows a similar view of the device shown in FIG. 1 with the bag inflated.

Referring firstly to FIGS. 1 and 2, the numeral 10 refers to the upper end of a typical elongate prop, such as the well known PIPESTICK. The prop includes a timber pole 12 which is received within a steel pot 14 having a base 16 which is arcuate in one plane. A shallow steel tray 18 having a base 20 and side walls 22 is pivoted to the pot by means of brackets 24 and pivot pins 26. Only one bracket and pivot pin combination is visible in the Figures, but it will be appreciated that a similar bracket and pin combination is provided symmetrically on the opposite side of the pot 14.

At the junctions of the side walls 22 and the base 20 of the tray 18, reinforcement is provided by lengths 30 of angle section steel.

A cover member 32 of open-top box shape and formed of steel mesh, expanded metal or the like is inverted over the tray 18 and makes a telescopic fit with the tray. In combination, the tray 18 and cover member form a rectangular enclosure of variable height.

The device of the invention also includes a liquid-tight bag 34 which has a filler nozzle 36. The bag 34 is sized to rest upon the tray and to fit into the enclosure defined by the tray and cover member. The filler nozzle 36 protrudes through an opening in the base of the tray and is accessible from below through the open end of the cover member 32.

In use, with the device of the invention installed at the end of the prop and with the bag empty and in position as illustrated in FIG. 1, the prop is arranged at an upright attitude between a hanging wall 38 and a footwall (not visible in the drawings). The prop has already been cut to such a length that with the bottom end of the prop resting upon the footwall, the cover member 32 is spaced a short distance below the hanging wall.

A conduit extending from a pumped supply of a suitable cementitious mix or other settable substance is connected up to the filler nozzle 36 and the grout is pumped into the bag to cause it to inflate. As the bag inflates, the cover member 32 telescopes apart from the tray and eventually presses up against the hanging wall. The material of which the cover member is made is preferably fairly flexible so that it can take up the irregular shape of the hanging wall.

With a suitable pumping pressure, a preload force of predetermined magnitude, typically a magnitude of some tons, can be applied to the prop. The filler nozzle includes a non-return valve of any suitable kind to prevent the settable substance from flowing back out of the bag once a desired internal pressure has been attained and the feed conduit is disconnected from the nozzle. The settable substance now sets to maintain the desired compressive preload force on the prop.

Once preloaded in this way to an appropriate level, the prop will immediately be in the condition to accept further compressive load as the hanging wall closes on the footwall with passage of time.

An important feature of the device described above is the provision for swivelling movement of the tray relative to the prop. As stated previously, the base 16 of the pot 14 is arcuate in one plane. The curvature of the base is matched by an arcuate depression 40 in the base 20 of the tray 18. The depression and the base of the pot mate with one another as illustrated and, with the described arrangement of brackets 24 and pins 26, the tray is capable of swivelling relative to the pot in one plane as indicated by the reference numeral 42. With this arrangement it is possible to orientate the prop, about its own axis, to suit any dip in the hanging wall before the bag is inflated to lock the prop in position. FIG. 2 shows the hanging wall to have a substantial dip relative to the horizontal, with the tray, cover member and bag orientated at the correct attitude to suit the dip.

Figure 3:
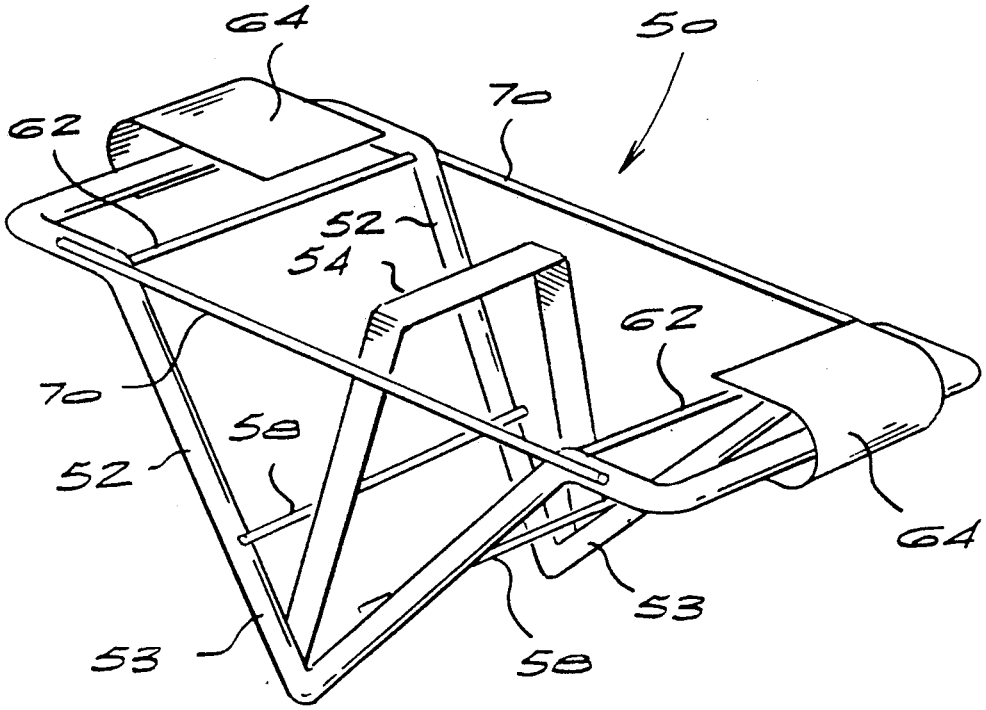
FIG. 3 shows a perspective view of a headboard setting frame of the invention.

FIG. 3 shows a perspective view of a preferred headboard setting frame. The frame 50 has a tubular steel member 52 bent to the illustrated shape so as to provide two V-shaped, downwardly depending limbs 53. A stirrup 54 has its ends attached to the downwardly depending limbs at positions close to the apices thereof as illustrated.

The stirrup may be in the form of a rigid, U-shaped steel strap. Alternatively, it may be of flexible material, typically a thin gauge steel band or flexible woven webbing, say of nylon.

Figure 4:
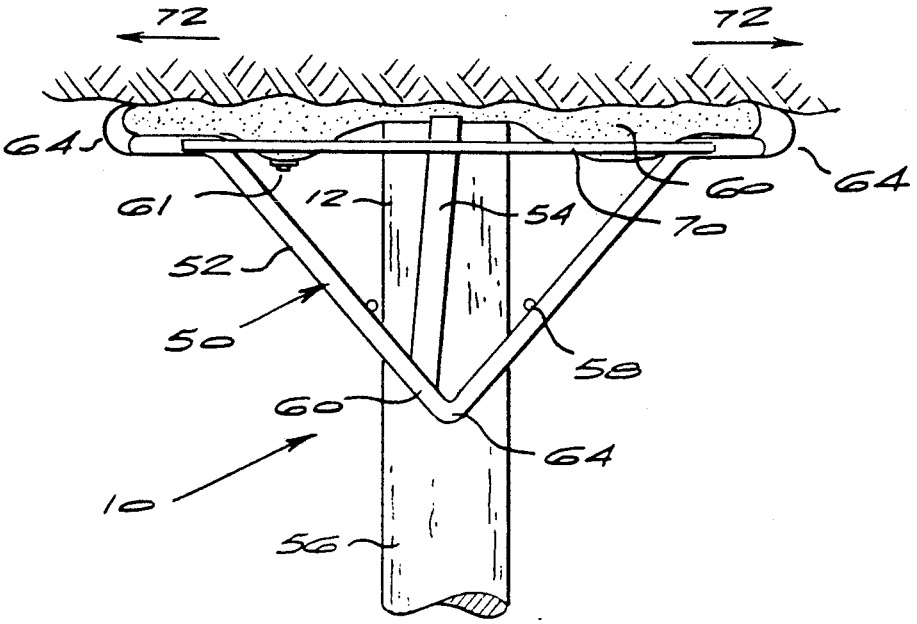
FIG. 4 shows a side view of the frame of FIG. 3 in use.
Figure 5:
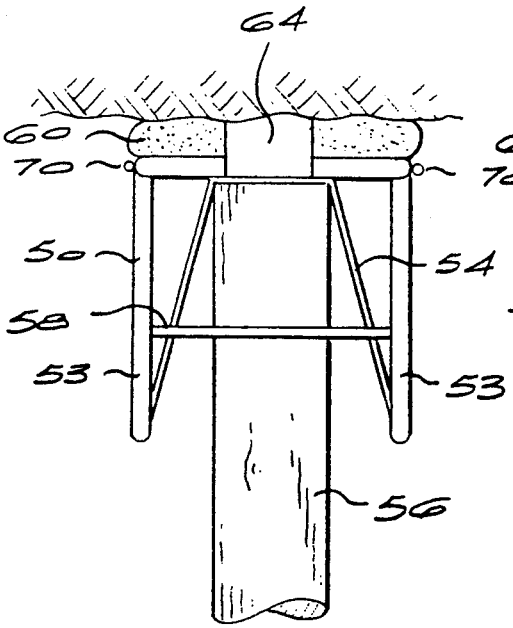
FIG. 5 shows and end view of what is seen in FIG. 3.
Figure 6:
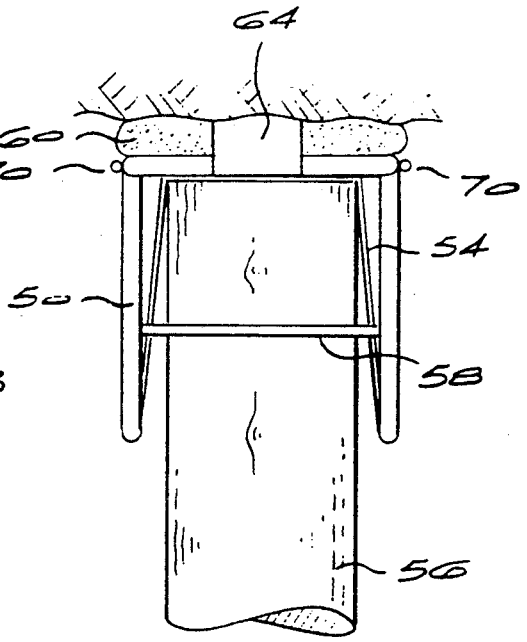
FIG. 6 shows a view similar to FIG. 5, but with the device fitted on a prop of larger diameter.

In use, as illustrated in FIGS. 4 to 6, the headboard setting frame is arranged on the upper end of an elongate prop which, as in the first embodiment, includes a timber pole 56. When properly installed, the limbs 53 are located on opposite sides of the upper end of the timber pole, as will be particularly clear from FIGS. 4 and 5. The stirrup 54 passes over the head of the prop as illustrated, and prevents the frame from moving downwardly relative to the timber pole.

FIG. 4 shows a timber pole of small diameter, while FIG. 5 shows a prop of somewhat larger diameter. It will be appreciated that, if the stirrup is of flexible material, the same frame can be used with both props. On the other hand, if the stirrup is of rigid material, this component may have to be modified slightly for different prop diameters. Even in the latter case, the other components of the frame are unchanged. Thus the frame has a good deal of versatility to take account of different prop diameters.

Spanning between the V-shaped limbs 53 are members 58. The spacing between these members is somewhat greater than the largest diameter prop with which the frame will be used. Thus the frame is capable of at least limited pivotal or swivelling movement relative to the prop before the side of the prop abuts the relevant member 58. In FIG. 4, the limited swivelling movement is about an axis into the plane of the paper. At the same time, because of the spacing between the limbs 53 and the sides of the prop, a limited degree of swivelling movement is permitted about a horizontal axis at right angles to the axis just referred to.

FIGS. 4, 5 and 6 also show an inflatable bag 60 with its filler nozzle 61. The bag 60, which can be identical to the bag 34 of the first embodiment, is made of any suitable material that can remain liquid tight while still withstanding the imposed loads in use. A typical construction for the bag will be that used for the known PACKSETTER bags, manufactured by Tufbag (Proprietary) Limited, that are used to preload mat packs in mine workings.

As illustrated, the bag 60 is placed on the head of the prop and is supported both by the prop itself and by cross-members 62 which span across the frame. An important feature of the frame design illustrated by FIGS. 3 to 6 is the provision of restraining members 64. These members are in the form of rectangular sheets of thin gauge steel. The sheets are welded to undersides of the end portions 66 of the frame 50 and are then bent over the ends of the bag 60 as illustrated. In practice, the sheets are bent over at the outset, and the un-inflated bag is slipped beneath them.

Once the frame, with the un-inflated bag is installed on the head of the prop, the appropriate grout is pumped into the bag through the filler nozzle 61. The preferred grout is that used in conjunction with the aforementioned PACK SETTER bags. As the bag is inflated with the grout under pressure, a preload force of some magnitude is applied to the prop to preload it in the axial direction.

To prevent the V-shaped limbs 53 from splaying apart, i.e. in the sense to increase their apex angles, braces 70 are provided that span across the bases of the limbs 53 as illustrated. Usually, the braces will be in the form of steel rods or strips, but flexible braces may also be used. As a less preferred alternative to providing the braces on the frame itself, it is possible to incorporate longitudinal braces within the bag 60. It will be appreciated that the cross-members 62 also prevent splaying apart of the limbs, i.e. in the sense in which the limbs actually move away from one another as load is applied.

Another advantageous feature of the frame 50 is its ability to stack compactly with other similar frames, as illustrated in FIG. 9. It will be appreciated that with rigid stirrups 54, it is necessary to off-set their connection points to the limbs 53 as described above and as illustrated so that efficient stacking can take place. Naturally the compactness with which the frames can be stacked facilitates their transport, both to a mine and to underground sites within the mine.

The major component of each frame is of course the member 52. Being of tubular construction, the member 52 and, as a result, the entire frame, is quite light and is easily manhandled.

Referring again to the restraining members 64, it will be noted in FIG. 4 that the hanging wall bears against these members and that they prevent movement of the bag relative to the prop in the direction 72. Thus the bag is held in the correct position on top of the prop even if the prop should skew slightly.

In other versions of the frame 50, the stirrup 54 could be omitted. In such cases, it would be necessary to provide some or other means to prevent downward movement of the frame relative to the prop as compressive loading is applied. This could be achieved suitable clamps or spikes on the frame to grip the periphery of the timber pole.

According to a further alternative contemplated by the invention, the frame 50 could be of hinged construction, enabling it to be folded compactly for transportation. Typically, hinges could be provided at the apices of the V-shaped limbs 53.

We claim:

1. A prop preloading apparatus comprising a frame, means for supporting the frame on an end of an elongate prop in a manner permitting at least limited swivelling movement of the frame relative to the prop about at least one axis transverse to the axis of the prop, and a flexible preload bag which is inflatable with a settable substance and which is dimensioned to be supported by the frame, wherein the frame includes a support member in the form of a tray for receiving and supporting the bag and wherein the apparatus includes a cover member which makes a telescopic fit with the tray and which, in combination with the support member, forms an enclosure for the bag.

2. A prop preloading apparatus according to claim 1 wherein the means for supporting the frame on the end of the prop includes an open-ended pot for receiving the head of the prop and means connecting the tray to the pot in a manner permitting the tray to pivot relative to the pot about an axis transverse to the prop axis.

3. A prop preloading apparatus according to claim 2 wherein the tray has an arcuate bearing surface which bears upon a complemental arcuate surface on the pot.

4. A prop preloading unit comprising a frame of open construction and made up of elongate frame members, the frame including a strap for passing over the end of an elongate prop for supporting the frame on the end of the prop, and the frame being adapted to support a flexible preload bag which is inflatable with a settable substance, wherein the frame presents spaced apart limbs arranged to locate on opposite sides of the end of the prop and wherein the frame includes re-entrant restraining members fixed to opposite edges of the frame to embrace opposite edge regions of the inflatable bag thereby no restrain transverse movement of the bag relative to the frame.

5. The prop preloading unit according to claim 4 wherein the restraining members comprise sheets of steel fixed to opposite ends of the frame, the sheets being bent inwardly on themselves to define spaces between the themselves and the frame into which the ends of the bag can be inserted in use.

6. A prop preloading unit according to claim 4 wherein the limbs are V-shaped.

7. A prop preloading unit according to claim 6 wherein the frame includes a pair of spaced members which span between the arms of the respective V-shaped limbs, which receive the end of the prop between them in use, and which define a limit of swivelling movement of the frame relative to the prop in use.

8. A prop preloading unit according to claim 6 wherein the ends of the strap are fixed to the limbs at positions adjacent to but off-set from the apices of the V-shapes, the arrangement begin such that the frame can stack compactly with another similar frame with the limbs nesting snugly with the limbs of the other frame.

9. A prop preloading unit according to claim 8 wherein the frame includes bracing members spanning across the base of each V-shaped limb to prevent the limbs from splaying under load.

10. A prop preloading unit according to claim 9 wherein the limbs are of tubular steel and are connected to one another by tubular steel joining portions at opposite ends of the frame.

11. The combination of:

(a) a prop preloading unit comprising a frame of open construction and made up of elongate frame members, the frame including a strap for passing over the end of an elongate prop for supporting the frame on the end of the prop, and the frame being adapted to support a flexible preload bag which is inflatable with a settable substance wherein the frame presents spaced apart limbs arranged to locate on opposite sides of the end of the prop, and wherein the frame includes re-entrant restraining members fixed to opposite edges of the frame to embrace opposite edge regions of the inflatable bag thereby to restrain transverse movement of the bag relative to the frame; and (b) an inflatable preload bag dimensioned to be supported by the frame and adapted to be inflated by settable grout under pressure.

* * * * *